US005723953A

United States Patent [19]

Nerone et al.

[11] Patent Number: 5,723,953

[45] Date of Patent: Mar. 3, 1998

[54] HIGH VOLTAGE IC-DRIVEN HALF-BRIDGE GAS DISCHARGE LAMP BALLAST

[75] Inventors: Louis R. Nerone, Brecksville; David J. Kachmarik, Strongsville, both of Ohio

[73] Assignee: General Electric Company, Schenectady, N.Y.

[21] Appl. No.: 718,178

[22] Filed: Sep. 19, 1996

[51] Int. Cl.[6] ..... G05F 1/00

[52] U.S. Cl. ..... 315/307; 315/224; 315/244; 315/209 R; 315/DIG. 7

[58] Field of Search ..... 315/307, 209 R, 315/224, 244, 291, 245, 102, 106, DIG. 5, DIG. 7

[56] References Cited

U.S. PATENT DOCUMENTS

| | | | |
|---|---|---|---|
| 4,791,338 | 12/1988 | Dean et al. | 315/174 |
| 5,382,881 | 1/1995 | Farkas et al. | 315/307 |
| 5,382,882 | 1/1995 | Nerone | 315/307 |
| 5,406,177 | 4/1995 | Nerone | 315/307 |
| 5,408,162 | 4/1995 | Williams | 315/224 |
| 5,612,597 | 3/1997 | Wood | 315/293 |

OTHER PUBLICATIONS

"Ballast IC Applications Information," International Rectifier Corporation, Oct. 1994, 3 pages.

"Compact Fluorescent Lamp," SGS–Thompson Microelectronics, Oct. 1995, 2 pages.

*Primary Examiner*—Robert Pascal

*Assistant Examiner*—Haissa Philogene

*Attorney, Agent, or Firm*—George E. Hawranko

[57] ABSTRACT

A ballast circuit for a gas discharge lamp of the type including resistively heated cathodes includes a resonant load circuit incorporating a gas discharge lamp and including first and second resonant impedances whose values determine the operating frequency of the resonant load circuit. Further included is a d.c.-to-a.c. converter circuit coupled to the resonant load circuit so as to induce an a.c. current in the resonant load circuit. The converter includes first and second switches serially connected between a bus conductor at a d.c. voltage and ground, and has a common node through which the a.c. load current flows. A feedback circuit provides a feedback signal indicating the level of current in the resonant load circuit. A high voltage IC drives the first and second switches at a frequency determined by a timing signal which predominantly comprises the feedback signal during lamp ignition, whereby during lamp ignition the feedback signal causes the high voltage IC to drive the first and second switches towards a switching frequency which promotes resonant operation of the resonant load circuit. A circuit isolates the feedback signal from the timing signal for a predetermined period of time upon energizing of said converter circuit so as to allow the cathodes to become heated during such period of time, prior to lamp ignition.

15 Claims, 5 Drawing Sheets

HIGH VOLTAGE IC-DRIVEN HALF-BRIDGE GAS DISCHARGE LAMP BALLAST

CROSS-REFERENCE TO RELATED APPLICATION

The present application is related to application Ser. No. 08/648,232, entitled "High Voltage IC-Driven Half-bridge Gas Discharge Ballast," filed on May 13, 1996 by the same inventors as in the present application, and assigned to the same assignee as the present application.

FIELD OF THE INVENTION

A first aspect of the present invention relates to a ballast circuit for a gas discharge lamp which employs a high voltage integrated circuit (HVIC) for driving a pair of serially connected switches that supply a.c. current to the lamp, and, more particularly to such a ballast circuit that applies a feedback signal to the HVIC for selecting a suitable frequency of operation during lamp starting. A second aspect of the invention, claimed herein, relates to such a ballast circuit including a cathode pre-heat function.

BACKGROUND OF THE INVENTION

One type of ballast circuit for a gas discharge lamp employs a pair of serially connected switches supplying a.c. current to the lamp, which is located in a resonant load circuit. The switches are configured in a half-bridge, Class D inverter configuration. Recently, a variety of high voltage integrated circuits (HVICs) have become available for driving such a half-bridge configuration in an alternating manner, i.e., first turning on one switch, turning it off, then turning on the second switch, turning it off, and so on. Beneficially, such HVICs could replace a variety of discrete circuit component at low cost and with reduction of ballast size. However, the HVICs are designed to provide a fixed frequency of switching of the pair of switches. While fixed frequency operation is typically suitable for steady state operation of gas discharge lamps, it is not suitable for operation during lamp ignition when it is desired that the frequency of the resonant load circuit approach its natural resonance frequency so as to result in a very high voltage spike necessary to cause lamp ignition.

Therefore, according to a first aspect of the invention, it would be desirable to overcome the foregoing deficiency of a mentioned HVIC so that, during lamp ignition, it will cause the resonant load circuit to approach its natural resonance frequency, to allow the generation of a high voltage spike to ignite the lamp.

According to a second aspect of the invention, it would be desirable to provide the foregoing ballast circuit with a cathode pre-heat function.

OBJECTS AND SUMMARY OF THE INVENTION

In accordance with a first aspect of the invention, it is an object of the invention to provide a gas discharge ballast circuit incorporating a pair of serially connected switches for supplying a.c. current to a resonant load circuit, which circuit utilizes a HVIC for driving the pair of switches but which is configured to result in a frequency shift during lamp ignition towards the natural frequency of resonance of the load circuit.

In accordance with a second aspect of the invention, claimed herein, it is an object to provide a ballast of the foregoing type, including a cathode pre-heat function.

In accordance with second aspect of the invention, claimed herein, there is provided a ballast circuit for a gas discharge lamp of the type including resistively heated cathodes. The ballast comprises a resonant load circuit incorporating a gas discharge lamp and including first and second resonant impedances whose values determine the operating frequency of the resonant load circuit. Further included is a d.c.-to-a.c. converter circuit coupled to the resonant load circuit so as to induce an a.c. current in the resonant load circuit. The converter includes first and second switches serially connected between a bus conductor at a d.c. voltage and ground, and has a common node through which the a.c. load current flows. A feedback circuit provides a feedback signal indicating the level of current in the resonant load circuit. A high voltage IC drives the first and second switches at a frequency determined by a timing signal which predominantly comprises the feedback signal during lamp ignition, whereby during lamp ignition the feedback signal causes the high voltage IC to drive the first and second switches towards a switching frequency which promotes resonant operation of the resonant load circuit. A circuit isolates the feedback signal from the timing signal for a predetermined period of time upon energizing of said converter circuit so as to allow the cathodes to become heated during such period of time, prior to lamp ignition.

BRIEF DESCRIPTION OF THE DRAWINGS

The foregoing objects and further advantages and features of the invention will become apparent from the following description when taken in conjunction with the drawing, in which like reference numerals refer to like parts, and in which.

DETAILED DESCRIPTION OF THE PREFERRED EMBODIMENTS

Figure 4:
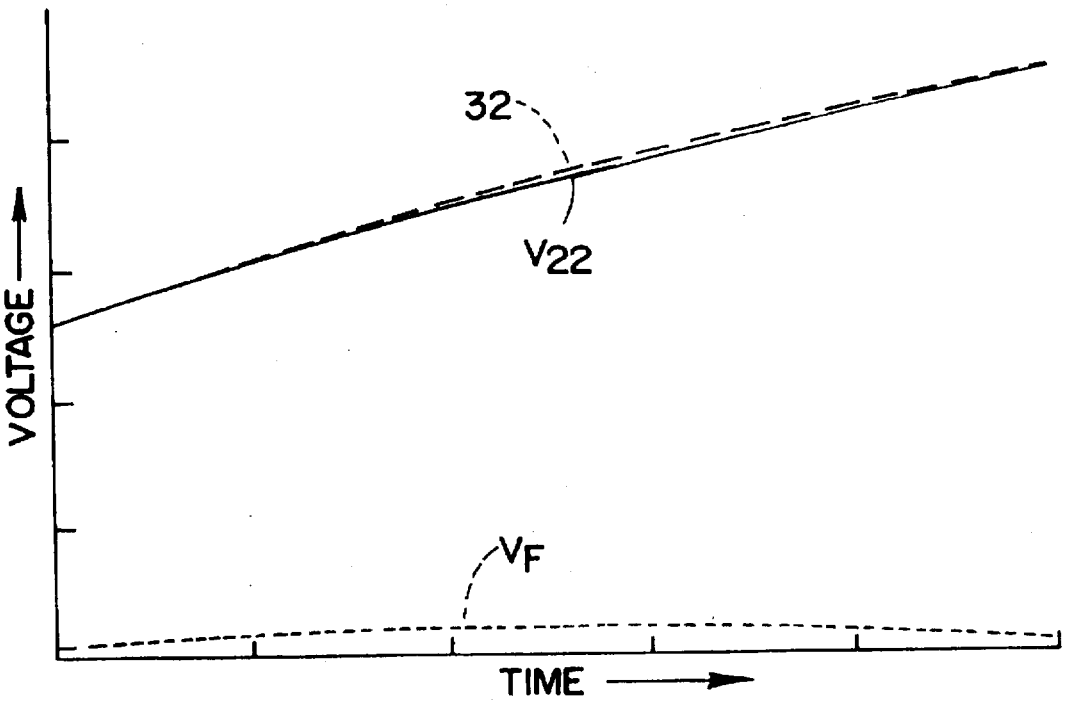
FIG. 4 is a plot of a timing voltage and related voltages versus time for steady state lamp operation.
Figure 5:
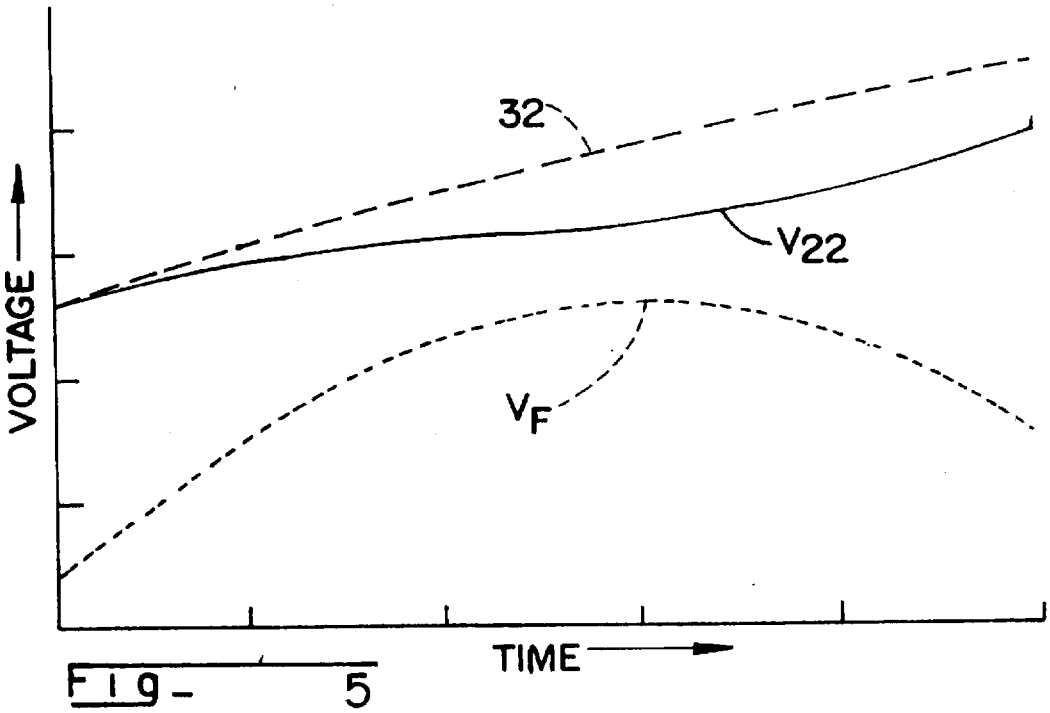
FIG. 5 is similar to FIG. 4 but illustrates voltages during lamp ignition.
Figure 6:
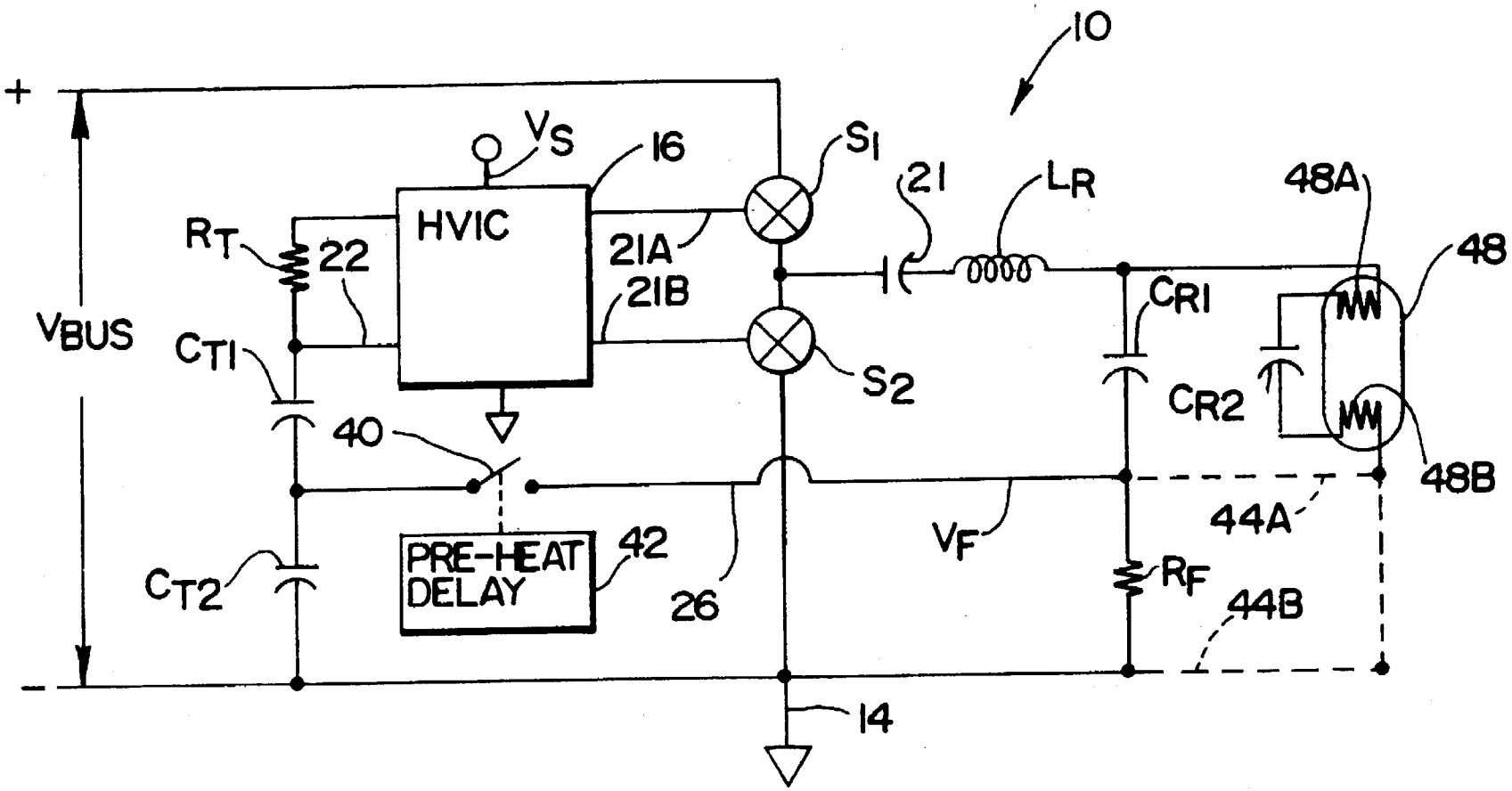
FIG. 6 is a schematic diagram, partly in block form, of a ballast circuit for a gas discharge lamp in accordance with a second aspect of the invention, which is claimed herein.
Figure 7:
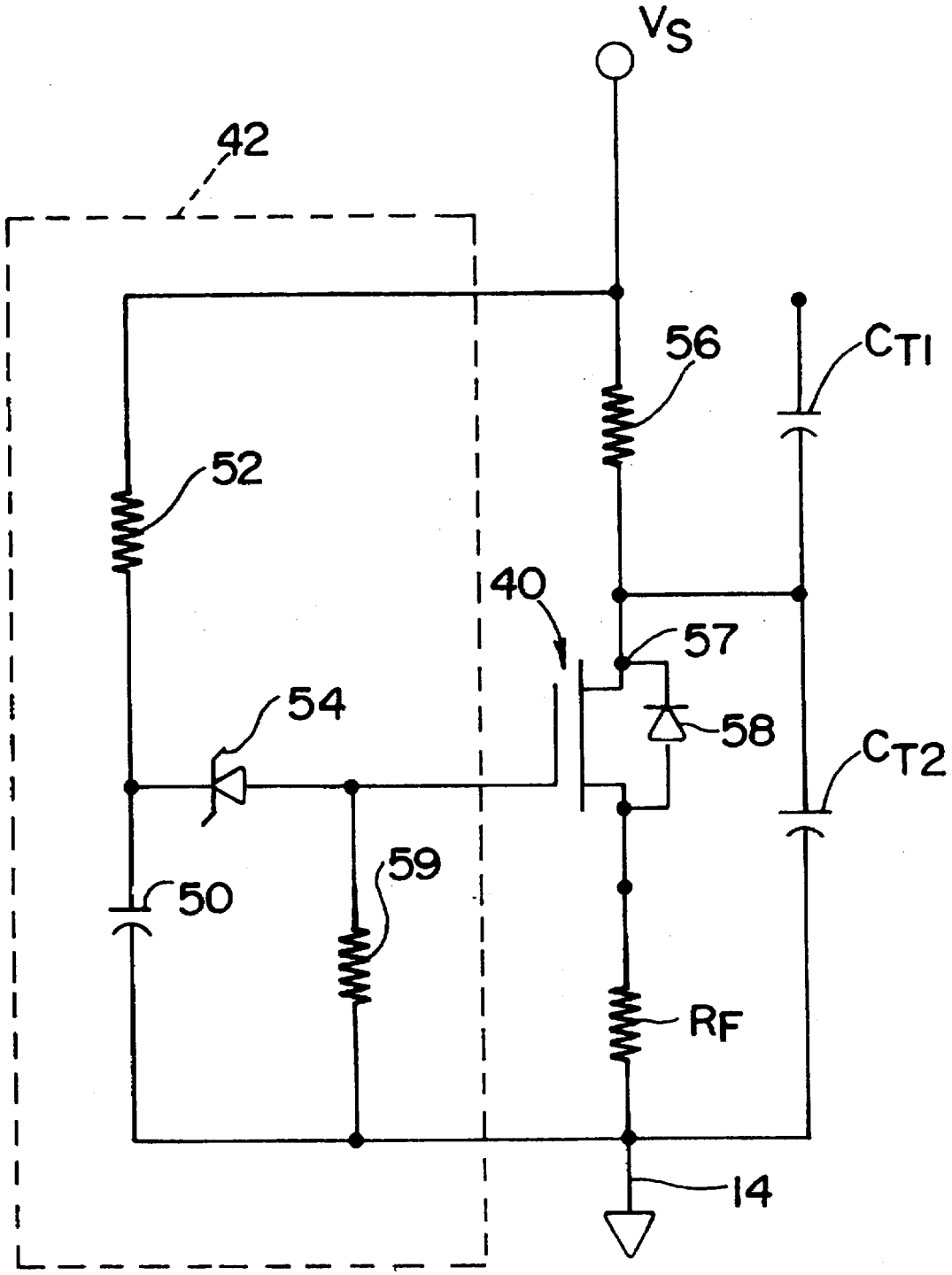
FIG. 7 is a schematic diagram of a cathode preheat delay circuit 42, a switch 40, and associated circuitry of ballast 10' of FIG. 6.

The presently claimed aspect of the invention is particularly directed to the embodiment shown in FIGS. 6 and 7. However, the following description of the embodiment of FIG. 1 and explanatory FIGS. 2–5 are relevant, because the embodiment of FIG. 6 improves over the embodiment of FIG. 1 by the inclusion of a cathode pre-heat function.

Figure 1:
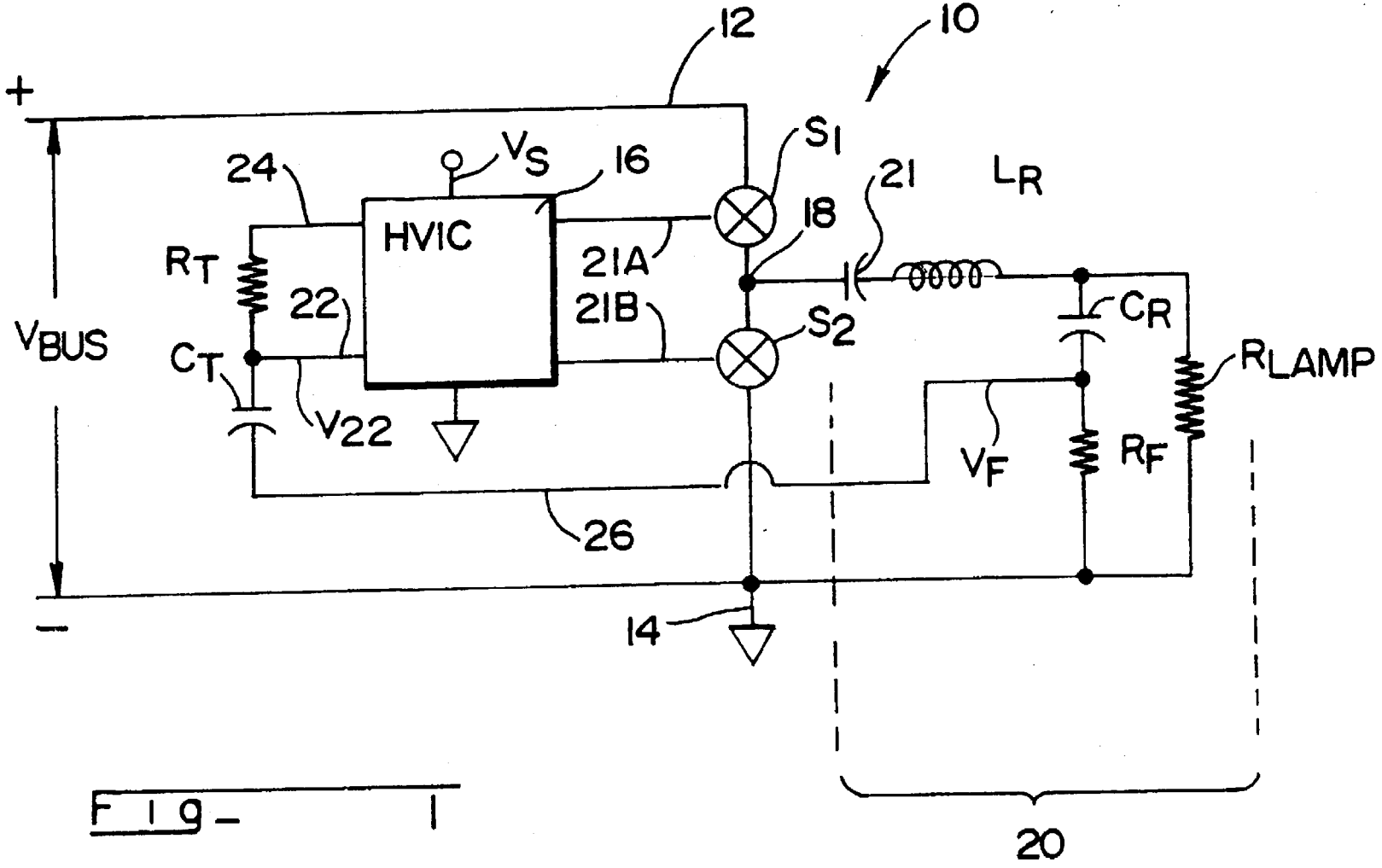
FIG. 1 is a schematic diagram, partly in block form, of a ballast circuit for a gas discharge lamp in accordance with a first aspect of the invention.

FIG. 1 shows a ballast circuit 10 for powering a gas discharge (e.g. fluorescent) lamp, which is designated $R_{LAMP}$, because it may exhibit resistive impedance during operation. Ballast circuit 10 includes a pair of serially connected switches $S_1$ and $S_2$, such as power MOSFETs, which are connected to receive a d.c. bus voltage $V_{Bus}$ between a bus conductor 12 and a ground 14. Control of switches $S_1$ and $S_2$ is provided by a high voltage integrated circuit (HVIC) 16, whose details are discussed below. By the alternate switching of $S_1$ and $S_2$, node 18 is alternately connected to bus voltage $V_{bus}$ and to ground 14. A resonant load circuit 20, connected to node 18, includes a resonant inductor $L_R$, a resonant capacitor $C_R$, and the lamp $R_{LAMP}$. A capacitor 21 provides d.c. blocking for load circuit 20. A feedback resistor $R_F$ is further included for purposes to be discussed below. Due to its connection to node 18, a.c. current is induced in resonant load circuit 20.

HVIC 16 may comprise a half-bridge driver with oscillator, such as sold by SGS-Thompson under its product designation L6569, entitled "High Voltage Half Bridge Driver with Oscillator; or, such as sold by International Rectifier Company of El Segundo, Calif. under its product designation IR2151, and entitled "Self-Oscillating Half-Bridge Driver." Respective high and low voltage outputs 21A and 21B from HVIC 16 drive switches $S_1$ and $S_2$. A timing resistor $R_T$ and timing capacitor $C_T$ are shown connected to HVIC 16. Timing resistor $R_T$ is shown connected between a capacitor timing input 22 and a resistor timing input 24, as in conventional. Meanwhile, a timing capacitor $C_T$ is shown connected at one end to capacitor timing input 22, as is conventional; however, the connections for the other end of timing capacitor $C_T$ are not conventional, and, indeed, such connections relate to the inventive use of HVIC 16 in ballast circuit 10 so as to provide for the automatic generation of a very high voltage spike (e.g., 1,000–1,200 volts) across the lamp $R_{LAMP}$ during lamp ignition. Thus, a feedback signal, e.g., voltage $V_F$ is applied to the lower-shown end of timing capacitor $C_T$ by wire 26, which leads from the upper-shown end of feedback resistor $R_F$. In contrast, it would be conventional to connect the lower end of timing capacitor $C_T$ directly to ground, without any feedback voltage $V_F$ reaching timing input 22 of HVIC 16.

Both of the above-mentioned HVICs employ a timing input 22, which receives a timing signal $V_{22}$, with the resulting frequency of switching of switches $S_1$ and $S_2$ being determined by the respective times of transition of timing signal $V_{22}$ from one threshold voltage to another threshold voltage, and vice-versa. Thus, referring to FIG. 2, a possible timing signal $V_{22}$ is shown transitioning between a pair of voltage thresholds, which, as shown, may be ⅓ of a supply voltage $V_S$, which supplies HVIC of FIG. 1, and ⅔ of supply voltage $V_S$. Typically, when timing signal $V_{22}$ increases from the lower threshold and reaches the upper threshold, the upper end of timing resistor $R_T$ becomes connected to ground 26 so that timing signal $V_{22}$ discharges through the timing resistor. Similarly, when timing signal $V_{22}$ then decays to the lower threshold, the upper end of timing resistor $R_T$ is then connected to supply voltage $V_S$, causing timing signal $V_{22}$ to increase towards the upper threshold. At the transition points, e.g., at times $t_1$, $t_2$, $t_3$, and $t_4$ in FIG. 2, alternate switching of switches $S_1$ and $S_2$ is caused.

Prior to lamp ignition, the lamp $R_{LAMP}$ appears as an extremely high resistance. During this time, the so-called "Q" or quality factor of resonant load circuit 20 is very high, because the lamp does not add a significant (i.e., low) resistive load to the circuit. During this time, it is advantageous to control switches $S_1$ and $S_2$ so that the frequency of operation of resonant load circuit 20 approaches its natural resonance point. When this occurs, the voltage placed across the lamp achieves the very high spike necessary to cause lamp ignition.

Figure 3:
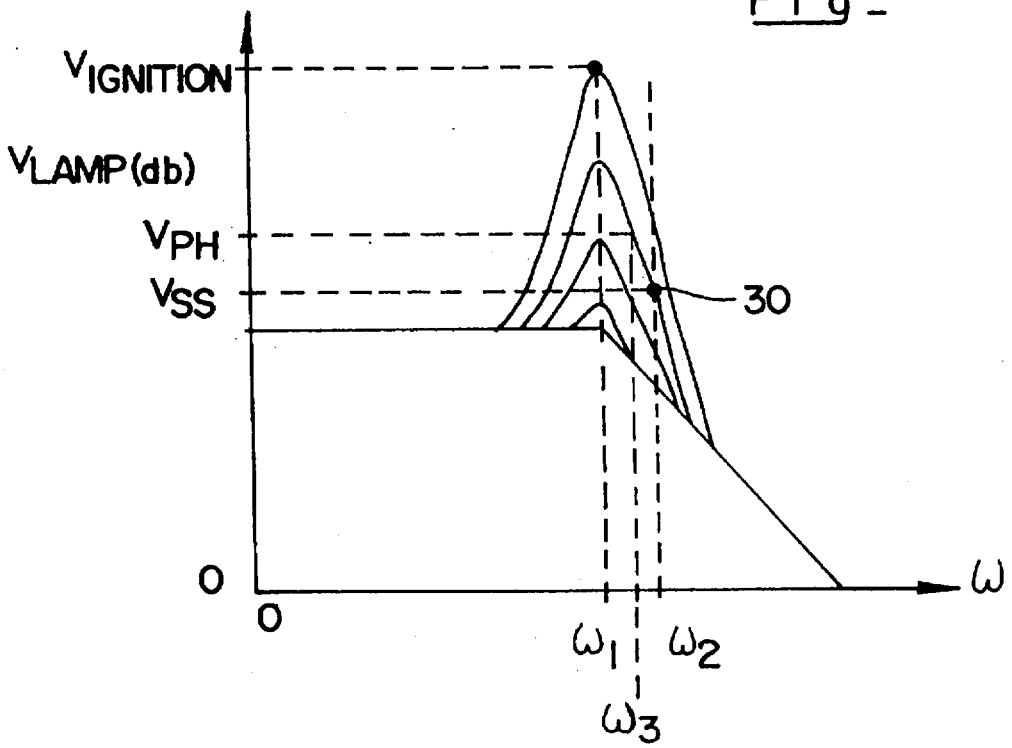
FIG. 3 is a simplified lamp voltage-versus-angular frequency graph illustrating operating points for lamp ignition and for steady state modes of operation.

FIG. 3 shows a simplified lamp voltage-versus-angular frequency graph to explain operation of the lamp as between ignition and steady state modes. Lamp voltage is measured in decibels, and angular frequency is measured in radians ($\omega$), i.e., $2\pi$ times frequency. At angular frequency $\omega_2$, a steady state operating point is shown at 30, at a steady state voltage $V_{SS}$. By decreasing the angular frequency to $\omega_1$, however, the lamp voltage rises sharply to $V_{IGNITION}$ which is sufficient to cause the lamp to ignite. After ignition, the lamp exhibits a much lower resistance, and adds to the lossiness of resonant load circuit 20, decreasing its Q factor, and, hence, resulting in the lower, steady state voltage $V_{SS}$.

Figure 2:
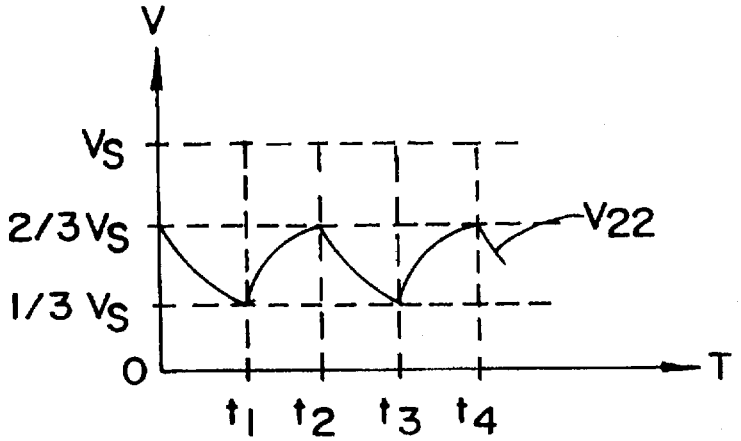
FIG. 2 is a voltage-versus-time graph of a typical timing signal applied to a timing input of a high voltage integrated circuit of FIG. 1.

By applying feedback signal $V_F$ to timing input 22 of HVIC 16, a desired shift in angular frequency will occur during lamp ignition to attain the very high voltage spike necessary for igniting the lamp. FIG. 2 shows a timing signal $V_{22}$ with substantially symmetrical upward and downward exponential transitions having the same time constant such as would occur if timing input 22 of HVIC 16 were connected in the conventional manner described above. This results in a fixed frequency of operation of the lamp, which would be suitable for steady state lamp operation. Timing voltage $V_{22}$ on timing input 22 of HVIC 16 constitutes the sum of voltage contributions from timing capacitor $C_T$ as it is charged or discharged, as well as a voltage contribution from feedback voltage $V_F$. During steady state lamp operation, feedback voltage $V_F$ is typically quite small in relation to the contribution due to the charging or discharging of timing capacitor $C_T$. Thus, during steady state lamp operation, timing voltage $V_{22}$ is predominantly determined by the charging or discharging of timing capacitor $C_T$. (Other embodiments, however, might have the timing voltage predominantly controlled by a feedback voltage during steady state operation.) FIG. 4 illustrates the summation of voltages to produce timing voltage $V_{22}$.

In FIG. 4, the solid curve shows timing voltage $V_{22}$. The longer dashed-line curve 32 shows the contribution due to charging of timing capacitor $C_T$. Meanwhile, the shorter dashed-line curve $V_F$ indicates a very small feedback signal. Thus, timing voltage $V_{22}$ is predominantly determined by the charging of capacitor $C_T$ during steady state operation. Now, referring to FIG. 5, these same voltages during lamp ignition are illustrated.

Referring to FIG. 5, the invention takes advantage of the much higher voltages (and currents) present in resonant load circuit 20 during lamp ignition, when such circuit is essentially unloaded by the lamp (i.e., the lamp does not have a low resistance during this time). During lamp ignition, therefore, feedback signal $V_F$ will be very much higher than during steady state lamp operation. While curve 32 showing the contribution from charging of timing capacitor $C_T$ appears similar to as shown for the steady state case of FIG. 4, timing voltage $V_{22}$ in FIG. 5 does not increase as quickly. The reason is that, at timing input 22 of HVIC 16, the voltage contribution from timing capacitor $C_T$ is summed with the inverse value of feedback voltage $V_F$. For illustration, however, feedback voltage $V_F$ is shown, rather than its inverse value. Adding the inverse value of feedback voltage $V_F$ to curve 32 results in the significant lowering of timing voltage $V_{22}$ noted above. As a consequence, the transition time of timing voltage $V_{22}$ from one threshold to another, as discussed above in connection with FIG. 2, is increased. As can be appreciated from FIG. 2, the frequency of operation of HVIC 16 is reduced. Such reduction in frequency is from a steady state operating frequency $\omega_2$ shown in FIG. 3, towards the natural resonant frequency of resonant load circuit 20 shown at $\omega$. This results in the very high lamp voltage spike necessary for lamp ignition. However, once lamp ignition is achieved, feedback voltage $V_F$ and other voltage levels in the resonant load circuit sharply decrease, whereby such feedback voltage then has a negligible effect on timing voltage $V_{22}$ as described above in connection with FIG. 4. With regard to FIG. 3, operation at frequency $\omega_3$ is described in connection with FIG. 6 below.

For a 20-watt lamp, typical values for the components of ballast circuit 10 of FIG. 1 for a bus voltage $V_{Bus}$ of 170 volts are as follows: resonant inductor $L_R$, 800 micro henries; resonant capacitor $C_R$, 5.6 nanofarads; feedback resistor $R_F$, 3.3 ohms; d.c. blocking capacitor 21, 0.22 micro farads; timing resistor $R_T$, 10.5 K ohms, and timing capacitor $C_T$, 0.001 microfarads.

FIG. 6 shows a preferred ballast 10' in accordance with a second aspect of the invention, which is claimed herein. As between FIG. 1, for instance, and FIG. 6, like reference numerals refer to like pans. Therefore, description of FIG. 6 will be mainly confined to the changes from FIG. 1. In particular, ballast 10' of FIG. 6 now includes a pair of timing capacitors $C_{T1}$ and $C_{T2}$, with the latter connecting the bottom node of capacitor $C_{T1}$ to ground 14. Feedback voltage $V_F$ is derived from the ungrounded node of feedback resistor $R_F$, but is impressed on the bottom-shown node of capacitor $C_{T1}$ only when a switch 40, under the control of a cathode pre-heat delay circuit 42, is closed. Meanwhile, one of conductors 44A and 44B is used in connection with feedback resistor $R_F$, the other being omitted. Preferably, conductor 44A is used for a relatively low bus voltage $V_{Bus}$ (e.g., 10 volts), and conductor 44B for a relatively high bus voltage $V_{Bus}$ (e.g., 300 volts). Finally, lamp 48 is shown with resistively heated cathodes 48A and 48B, with a resonant capacitor $C_{R2}$ connected across the cathodes. The foregoing items will be described in more detail below.

Cathode preheat delay circuit 42 operates in conjunction with timing capacitors $C_{T1}$ and $C_{T2}$ to provide a cathode preheat period prior to lamp ignition. During such period, resistively heated cathodes 48A and 48B become heated to a suitable level. Cathode preheat delay circuit 42 operates for typically about one second after a suitable level of bus voltage $V_{Bus}$ is first provided; then it closes switch 40 so as to impose feedback voltage $V_F$ on the lower node of timing capacitor $C_{T1}$. Prior to switch 40 being closed, feedback voltage $V_F$ has no influence on voltage $V_{22}$ on timing node 22 of HVIC 16. During this time, the effective timing capacitance between node 22 and ground 14 is the serial combination of capacitors $C_{T1}$ and $C_{T2}$. For instance, with capacitor $C_{T1}$ rated at 1.0 nanofarads and capacitor $C_{T2}$ rated at 4.7 nanofarads, the serial capacitance of the two capacitors is about 0.82 nanofarads. Thus, the time constant for voltage $V_{22}$ in FIG. 2 will be less than for the typical values given for ballast 10 of FIG. 1 above wherein timing capacitor $C_T$ (FIG. 1) is rated at 1 nanofarad (0.001 microfarads). Referring to FIG. 3, the frequency of operation is $\omega_3$, with a cathode preheat lamp voltage $V_{PH}$ as shown.

After switch 40 is closed, the lower node of timing capacitor $C_{T1}$ is connected through the parallel combination of timing capacitor $C_{T2}$ and feedback resistor $R_F$ to ground 14. However, with feedback resistor $R_F$ typically having an impedance of about one ohm, and being much lower in impedance than timing capacitor $C_{T2}$, the lower node of capacitor $C_{T1}$, can considered approximately as being connected directly to ground 14 when switch 40 is closed. With such approximation, the timing components $R_T$ and $C_{T1}$ associated with HVIC 16 in FIG. 6 will be seen as directly analogous to the timing components in FIG. 1 associated with the timing resistor $R_T$ and timing capacitor $C_T$ associated with HVIC 16 in FIG. 1. Therefore, operation of ballast 10' of FIG. 6 with switch 40 closed is the same as operation of ballast 10 of FIG. 1 as described above.

FIG. 7 shows a preferred implementation of the following parts of ballast 10' of FIG. 6: Cathode preheat delay circuit 42, together with switch 40, timing capacitors $C_{T1}$ and $C_{T2}$, and feedback resistor $R_F$. Circuit 42 includes a capacitor 50 that is charged from supply voltage $V_S$ (FIG. 6) via a resistor 52. Capacitor 50 is sized such that it is substantially unaffected by a.c. voltage on feedback resistor $R_F$; such a.c. voltage on resistor $R_F$ is typically only a few tenths of a volt during the cathode preheat period, as compared to several volts during lamp ignition. Capacitor 50 becomes charged to the point where a Zener diode 54 breaks down, causing switch 40 to turn on. Switch 40 may suitably comprise an n-channel enhancement mode MOSFET. A resistor 56 keeps upper node 57 of switch 40 above the potential of ground 14, so that the inherent diode 58 of switch 40 does not conduct; this prevents discharging of timing capacitor $C_{T2}$, which would interfere with the frequency of oscillation of switches $S_1$ and $S_2$ of ballast 10' (FIG. 6). Meanwhile, a resistor 59 prevents leakage current through Zener diode 54 from charging capacitor 50 and turning on switch 40.

For a 25-watt lamp and a bus voltage $V_{BUS}$ of 160 volts, typical values for the components of ballast circuit 10' of FIG. 6 are as follows: resonant inductor $L_R$, 800 micro henries; resonant capacitor $C_{R1}$, 7.7 nanofarads; feedback resistor $R_F$, 1 ohm; d.c. blocking capacitor 21, 0.22 micro farads; timing resistor $R_T$, 10.5 K ohms; timing capacitor $C_{T1}$, 1.0 nanofarads; timing capacitor $C_{T2}$, 5.6 nanofarads; and typical values for the circuit of FIG. 7 are: capacitor 50, 0.33 microfarads; resistors 52, 56, and 59, each 2.4 Megohms; Zener diode 54, 7.5 volts rating; and MOSFET 40, an n-channel enhancement mode MOSFET, such as a product designated BSN20 from Philips Semiconductors of Eindhoven, Netherlands.

As mentioned above, embodiments of the invention can be made in which the feedback voltage $V_F$ predominates in establishing timing voltage $V_{22}$ both during lamp ignition and during steady state operation. For instance, the resistance of feedback resistor $R_F$ could be increased to increase the feedback voltage $V_F$ across it. Then, as opposed to the negligible contribution made by feedback voltage $V_F$ according to FIG. 4, the feedback voltage $V_F$ during steady state operation could be so large as to predominate over the contribution made by timing capacitor $C_T$. However, due to the increased resistive losses that would result in the feedback resistor $R_F$, the foregoing embodiment is not the preferred embodiment.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp having resistively heated cathodes, comprising:

(a) a resonant load circuit including first and second resonant impedances whose values determine the operating frequency of said resonant load circuit; said load circuit including means for incorporating a gas discharge lamp;

(b) a d.c.-to-a.c. converter circuit coupled to said resonant load circuit so as to induce an a.c. current in said resonant load circuit, and comprising first and second switches serially connected between a bus conductor at a d.c. voltage and ground, and having a common node through which said a.c. load current flows;

(c) a feedback circuit for providing a feedback signal varying in proportion to the level of current in said resonant load circuit;

(d) a high voltage IC for driving said first and second switches at a frequency determined by a timing signal; said timing signal predominantly comprising said feedback signal during lamp ignition, whereby during lamp ignition said feedback signal causes said high voltage IC to drive said first and second switches in continuous manner towards a switching frequency which promotes resonant operation of said resonant load circuit; and (e) means to isolate said feedback signal from said timing signal for a predetermined period of time upon energizing of said converter circuit so as to allow said cathodes to become heated during said period of time, prior to lamp ignition.

2. The ballast circuit of claim 1, wherein said feedback circuit is so constructed as to make said timing signal, during steady state lamp operation, predominantly determined by a signal other than said feedback signal.

3. The ballast circuit of claim 1, wherein:

(a) said high voltage IC includes a timing input that receives said timing signal, with the frequency of switching being determined by the respective times of transition of said timing signal from one threshold voltage to another threshold voltage, and vice-versa; and (b) said feedback signal is summed at said timing input with a signal which, in the absence of said feedback signal, would yield fixed-frequency operation of said first and second switches.

4. The ballast circuit of claim 3, further comprising a pair of timing capacitors serially connected between said timing input and ground.

5. The ballast circuit of claim 4, wherein said means to isolate comprises a switch connected between a common node of said serially connected timing capacitors and a conductor on which said feedback signal exists.

6. The ballast of claim 5, wherein said feedback circuit comprises a feedback resistor with one end connected to ground and with another end on which said feedback signal exists, the voltage across said resistor constituting said feedback signal.

7. The ballast of claim 5, wherein:

(a) said switch comprises a MOSFET having an inherent diode connected between its main current-conducting terminals; and (b) a resistor is provided between said common node and a d.c. supply voltage above ground potential so as to maintain said common node at above ground potential.

8. The ballast circuit of claim 1, wherein said gas discharge lamp comprises a fluorescent lamp.

9. A ballast circuit for a fluorescent lamp having resistively heated cathodes, comprising:

(a) a resonant load circuit incorporating a gas discharge lamp and including first and second resonant impedances whose values determine the operating frequency of said resonant load circuit;

(b) a d.c.-to-a.c. converter circuit coupled to said resonant load circuit so as to induce an a.c. current in said resonant load circuit, and comprising first and second switches serially connected between a bus conductor at a d.c. voltage and ground, and having a common node through which said a.c. load current flows;

(c) a feedback circuit for providing a feedback signal varying in proportion to the level of current in said resonant load circuit;

(d) a high voltage IC for driving said first and second switches; said high voltage IC including a timing input that receives a timing signal, with the frequency of switching of said first and second switches being determined by the respective times of transition of said timing signal from one threshold voltage to another threshold voltage, and vice-versa;

(e) said timing signal predominantly comprising said feedback signal during lamp ignition, whereby during lamp ignition said feedback signal causes said high voltage IC to drive said first and second switches in continuous manner towards a switching frequency which promotes resonant operation of said resonant load circuit; and (f) means to isolate said feedback signal from said timing signal for a predetermined period of time upon energizing of said converter circuit so as to allow said cathodes to become heated during said period of time, prior to lamp ignition.

10. The ballast circuit of claim 9, wherein said feedback signal is summed at said timing input with a second signal which, in the absence of said feedback signal, would yield fixed-frequency operation of said first and second switches.

11. The ballast circuit of claim 10, wherein said feedback circuit is so constructed as to make said timing signal, during steady state lamp operation, predominantly determined by said second signal.

12. The ballast circuit of claim 9, further comprising a pair of timing capacitors serially connected between said timing input and ground.

13. The ballast circuit of claim 12, wherein said means to isolate comprises a switch connected between a common node of said serially connected timing capacitors and a conductor on which said feedback signal exists.

14. The ballast of claim 13, wherein said feedback circuit comprises a feedback resistor with one end connected to ground and with another end on which said feedback signal exists, the voltage across said resistor constituting said feedback signal.

15. The ballast of claim 13, wherein:

(a) said switch comprises a MOSFET having an inherent diode connected between its main current-conducting terminals; and (b) a resistor is provided between said common node and a d.c. supply voltage above ground potential so as to maintain said common node at above ground potential.

* * * * *